US005934298A

United States Patent [19]

Singh

[11] Patent Number: 5,934,298

[45] Date of Patent: Aug. 10, 1999

[54] COMBINATION SINK AND DISHWASHER

[76] Inventor: Baljit Singh, 12124 Hebe Ave., Norwalk, Calif. 90650

[21] Appl. No.: 08/968,461

[22] Filed: Nov. 14, 1997

[51] Int. Cl.[6] ..... B08B 3/02

[52] U.S. Cl. ..... 134/85; 134/115 R; 134/201; 134/200

[58] Field of Search ..... 134/93, 115 R, 134/115 G, 176, 63, 201, 179, 85, 90, 91, 200

[56] References Cited

U.S. PATENT DOCUMENTS

| | | | |
|---|---|---|---|
| 696,556 | 4/1902 | Ervin | 134/85 |
| 909,604 | 1/1909 | Jaycox | 134/85 |
| 1,127,801 | 2/1915 | Oberheim | 134/85 |
| 1,246,556 | 11/1917 | Crow | 134/93 |
| 1,691,839 | 11/1928 | Caskin | 134/85 |
| 1,724,910 | 8/1929 | Cromwell | 134/179 |
| 2,003,003 | 5/1935 | Marbury | 134/176 |
| 2,632,452 | 3/1953 | Spitzer | 134/200 |
| 2,745,417 | 5/1956 | Fielding | 134/148 |
| 3,108,754 | 10/1963 | Low et al. | 134/115 G |
| 3,358,702 | 12/1967 | Schaap | 134/107 |
| 3,961,984 | 6/1976 | Torressen | 134/100 |
| 4,146,405 | 3/1979 | Timmer | 134/115 |
| 4,298,015 | 11/1981 | Garza | 134/100 |
| 4,557,283 | 12/1985 | Shaw | 134/177 |
| 4,811,997 | 3/1989 | Suyama | 312/228 |
| 4,919,162 | 4/1990 | Lumby | 134/115 |
| 5,193,562 | 3/1993 | Rigby | 134/57 |
| 5,470,142 | 11/1995 | Sargeant | 312/258 |

FOREIGN PATENT DOCUMENTS

| | | | |
|---|---|---|---|
| 517858 | 2/1931 | Germany | 134/85 |
| 339477 | 12/1930 | United Kingdom | 134/85 |

*Primary Examiner*—Frankie L. Stinson
*Attorney, Agent, or Firm*—GeneScott- Patent Law & Venture Group

[57] ABSTRACT

The present invention provides a combination sink and dishwashing apparatus having a sink sharing a common side wall with a cabinet which defines a closed space. The cabinet has a wire basket for holding and washing a plurality of dishes within the cabinet. The common side wall is a part of the cabinet that defines the closed space and is positioned to form one side of the sink. The common side wall can be opened to allow the wire basket to slide from within the cabinet and into the sink, for loading and unloading the dishes. Within the cabinet, the invention contains a pump powered by a motor, the pump spraying water through a rotatably mounted spray arm onto the dishes to wash them, as with traditional dishwashing machines. The invention preferably includes a garbage disposal which is also powered by the motor. In an alternative embodiment, this invention can include two cabinets as described above, each located on opposing sides of the sink.

12 Claims, 4 Drawing Sheets

Fig. 2
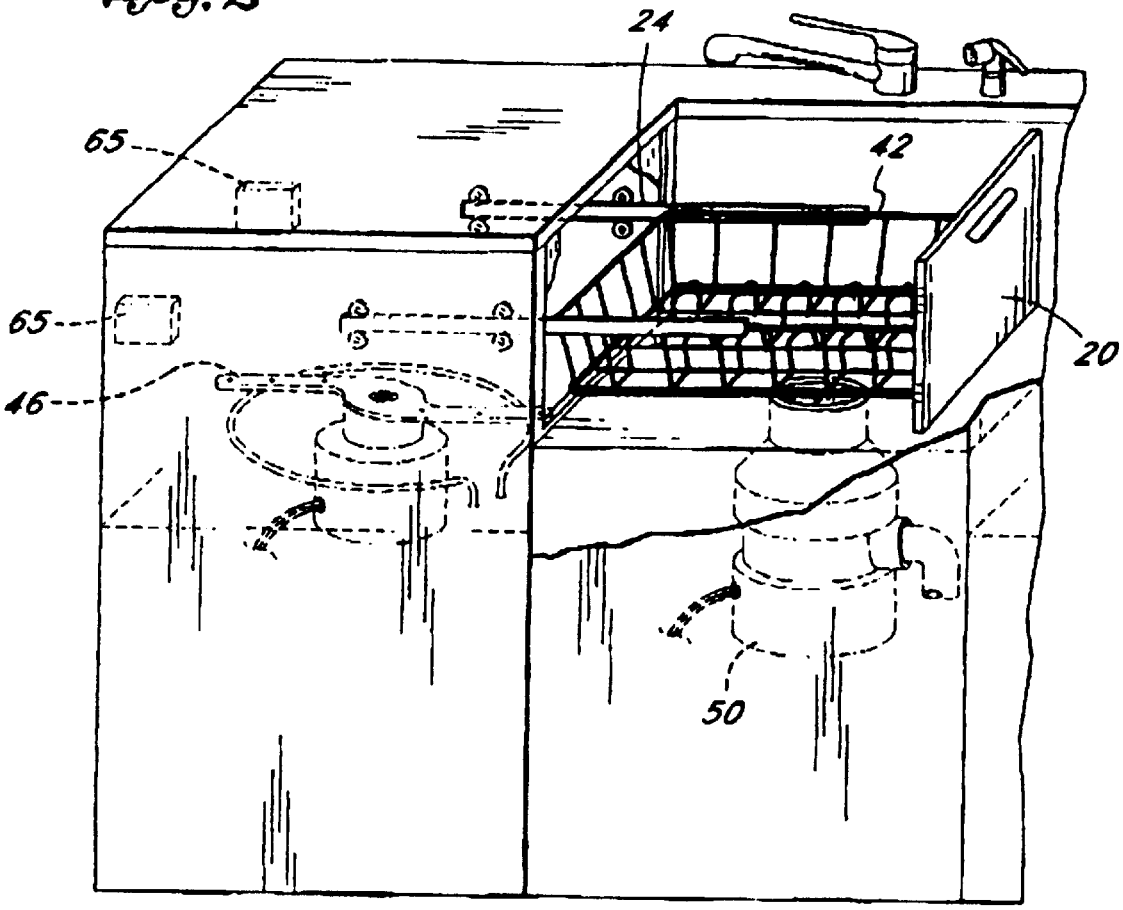
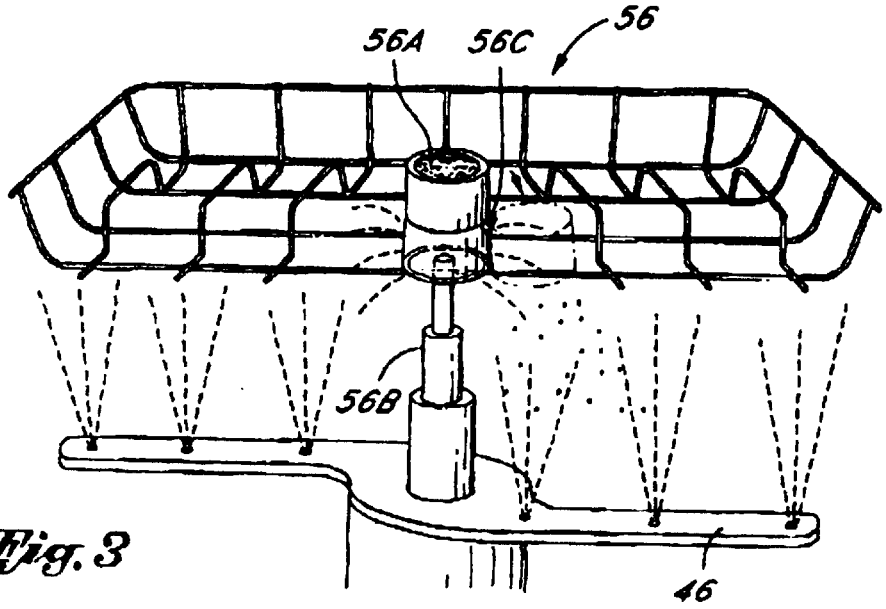
Fig. 3

COMBINATION SINK AND DISHWASHER

BACKGROUND OF THE INVENTION

This application for a utility patent claims the filing date of Aug. 16, 1997 of a previously filed provisional patent application having an unknown serial number and filed by the same inventor on the same subject matter.

1. Field of the Invention

This invention relates generally to dishwashers, and more particularly to a sink and dishwasher combination.

2. Description of Related Art

The following art defines the present state of this field:

Rigby, U.S. Pat. No. 5,193,562 describes an invention which discloses a sink mounted dishwasher having a closure mechanism in the drain of the sink. A hydraulic control system for such a dishwasher is also disclosed together with a hydraulically operated liquid detergent dispenser. The preferred form of hydraulic fluid is liquid rinse aid. Two forms of spray arm are also disclosed, each with a structure which enable the spray arm to be removably and rotatably mounted within the sink.

Shaw, U.S. Pat. No. 4,557,283 describes a portable, countertop dishwasher having a washing media dispensing nozzle structure which includes radially-projecting, washing media-dispensing arms and an improved unitary dish rack located in surrounding relationship with the axis of the nozzle structure and axially intermediate upper and lower nozzle structure pivot supports. The unitary dish rack includes support structures for supporting the articles to be washed within the radial sweep of the radially projecting arms of the nozzle structure and being selectively removable from the dishwasher independently of the nozzle structure.

Garza, U.S. Pat. No. 4,298,015 describes a dishwasher with a tub, dish rack and transparent lid cover with a centrally disposed turbine hydraulically actuated motor on the bottom of the tub. The motor has internal piping to lead water to a spray arm rotated by the turbine past a turbulence chamber serving to suck a charge of detergent into the water flow stream which when spent permits a water rinse. A rack has removable dish support clip members fixed onto rods or webs so that the only moving part is the turbine rotor and attached spray arm.

Torressen, U.S. Pat. No. 3,961,984 describes a compact dishwasher which is particularly adapted for placement in a sink or sink/tub combination and which connected directly to a faucet.

Timmer, U.S. Pat. No. 4,146,405 describes a complete dishwasher and sink assembly, including equipment usually installed separately, forms a unit that can be inserted in a cut-out in a countertop, and supported and secured in position at a peripheral flange. The connections to the associated utilities are positioned for maximum convenience to standard locations. A sink is pivotally mounted to provide a cover for the dishwasher chamber, and stiffener-deflector arrangements are provided to assure that the interior spray does not produce leakage out to the countertop through ventilation passages at the peripheral flange. Spray is applied to racks of dishes, preferably from rotating spray heads mounted on a movable carrier, with the supply of water to the spray heads being conducted via the hollow interior of the carrier and also the hollow interior of a sequence of interconnected links. The rotatable spray heads are also hollow, with molded projections forming directional jet orifices. The reciprocating carrier is supported on a rotatable double-helix screw shaft, with a portion of the carriage in sliding engagement with the wall of the spray chamber so that the carriage is suspended from the shaft. An auxiliary interior faucet is provided for rinsing dishes, with the spigot position determining the off-on condition of an associated valve.

Sargeant, U.S. Pat. No. 5,470,142 describes a dishwasher having a spray arm, motor and pump components configured and mounted so as to occupy very low height. In one form the complete wash system is arranged as a drawer which slides in and out of a cabinet. The cabinet opening is stiffened against racking forces by incorporating an inverse portal frame in the opening flange. A synchronous AC motor is used with the rotor running within the wash chamber driving a wash pump integrated with a rotating spray arm.

Suyama, U.S. Pat. No. 4,811,997 describes a dishwasher comprising of a main body having a washing tub. A box-like cover is mounted above the washing tub to be movable between a lower position to close the washing tub and an upper portion to expose the tub. A supporting frame having a channel-like cross section for supporting the cover and guiding the movement thereof is mounted so as to extend from the washing tub into the interior of the cover. A pair of coil springs are provided to the inside of the channel-like supporting frame and have respective lower ends secured on the supporting frame at the inner side thereof and respective upper ends secured to a shield member which assumes a blocking position to substantially close an opening formed in a top wall of the cover when the latter is at the upper position while assuming a releasing position where the top opening of the cover is released from the blocked state. The shield member is swingable between the blocking position and the releasing position.

Lumby, U.S. Pat. No. 4,919,162 describes a sink located dishwasher having a cover for the sink, a rack for dishes located in the sink, and a removable spray arm assembly mounted in the sink drain. The spray arm assembly includes a spray arm rotatably mounted at the upper end of a hollow shaft to rotate in the sink below the rack. A pair of seals are provided on the shaft to seal the shaft within the drain. Water is pumped from the drain above both seals and returned to the drain between the seals from where it flows up the hollow shaft and rotates the spray arm.

The prior art teaches dishwashers that can be independently installed next to a sink, and dishwashers that mount under a sink cabinet. However, the prior art does not teach a dishwasher which is built adjacent to and as an integral part of a sink whereby the sink and the dishwasher can exchange a dish basket. The present invention fulfills these needs and provides further related advantages as described in the following summary.

SUMMARY OF THE INVENTION

The present invention teaches certain benefits in construction and use which give rise to the objectives described below.

The present invention provides a combination sink and dishwashing apparatus having a sink sharing a common side wall with a cabinet which defines a closed space. The cabinet has a wire basket for holding and washing a plurality of dishes within the cabinet. The common side wall is a part of the cabinet that defines the closed space and is positioned to form one side of the sink. The common side wall can be opened to allow the wire basket to slide from within the cabinet and into the sink, for loading and unloading the dishes. Within the cabinet, the invention contains a means for spraying the dishes to wash them, as with traditional dishwashing machines. The invention also includes a motor which powers the means for spraying, and preferably powers a garbage disposal as well. In an alternative embodiment, this invention can include two cabinets as described above, each located on opposing sides of the sink.

A primary objective of the present invention is to provide a combination sink and dishwasher having advantages not taught by the prior art.

Another objective is to provide a dishwasher which does not require the user to bend over to load the dishes into the dishwasher.

A further objective is to provide a dishwasher which allows the dishes to be loaded and then rinsed off so that food left on the plates is washed directly into the sink; and this food, as well as food washed off inside the dishwasher, is all sent through a single garbage disposal.

A further objective is to provide a dishwasher which can be used efficiently without requiring the user to fill two full wire baskets with dishes before the dishwasher is run, thereby saving electricity, water and detergent.

A further objective is to provide a dishwasher and garbage disposal which can be operated with one common motor, without requiring a duplicate motor, and saving both money and space.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings:

FIG. 2 is a perspective view of an alternate embodiment of the present invention particularly showing a sink having a single dishwashing machine located laterally thereto and further particularly showing the manner in which a dish supporting basket may be moved from the dishwashing machine into the sink for loading;

FIG. 3 is a perspective view of a rotating spray bar located within the dishwashing machine and particularly showing a detergent dispenser preferred location above a telescoping water tower nozzle;

DETAILED DESCRIPTION OF THE INVENTION

Figure 4:
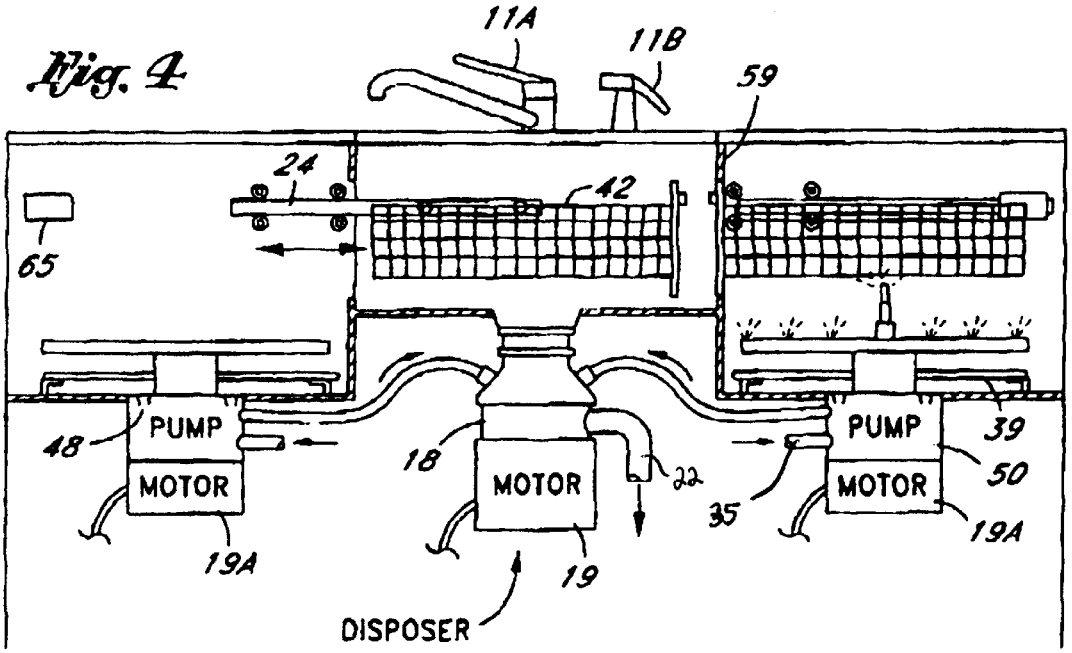
FIG. 4 is a schematic diagram of a front elevational sectional view of one version of the invention whereby separate motors are used to drive a garbage disposal and each of two water pumps in adjacent washing machines.
Figure 5:
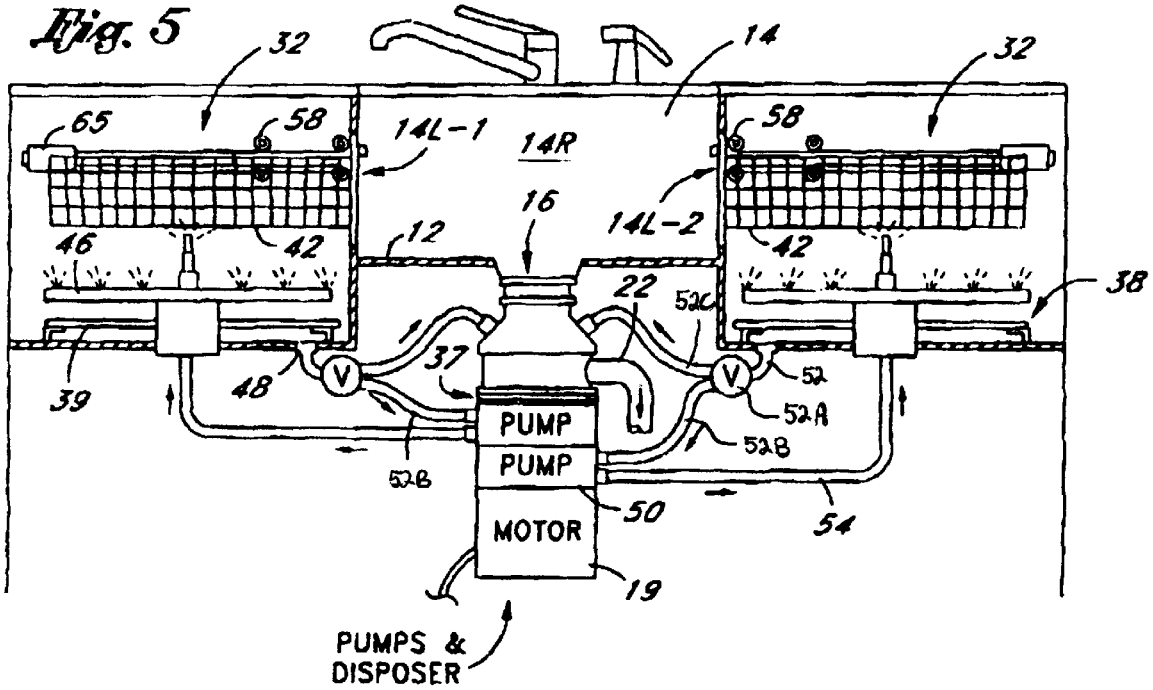
FIG. 5 is a view similar to that of FIG. 4 showing a preferred embodiment whereby the pumps which re-circulate the water in the cabinets are driven by the garbage disposal motor.
Figure 6:
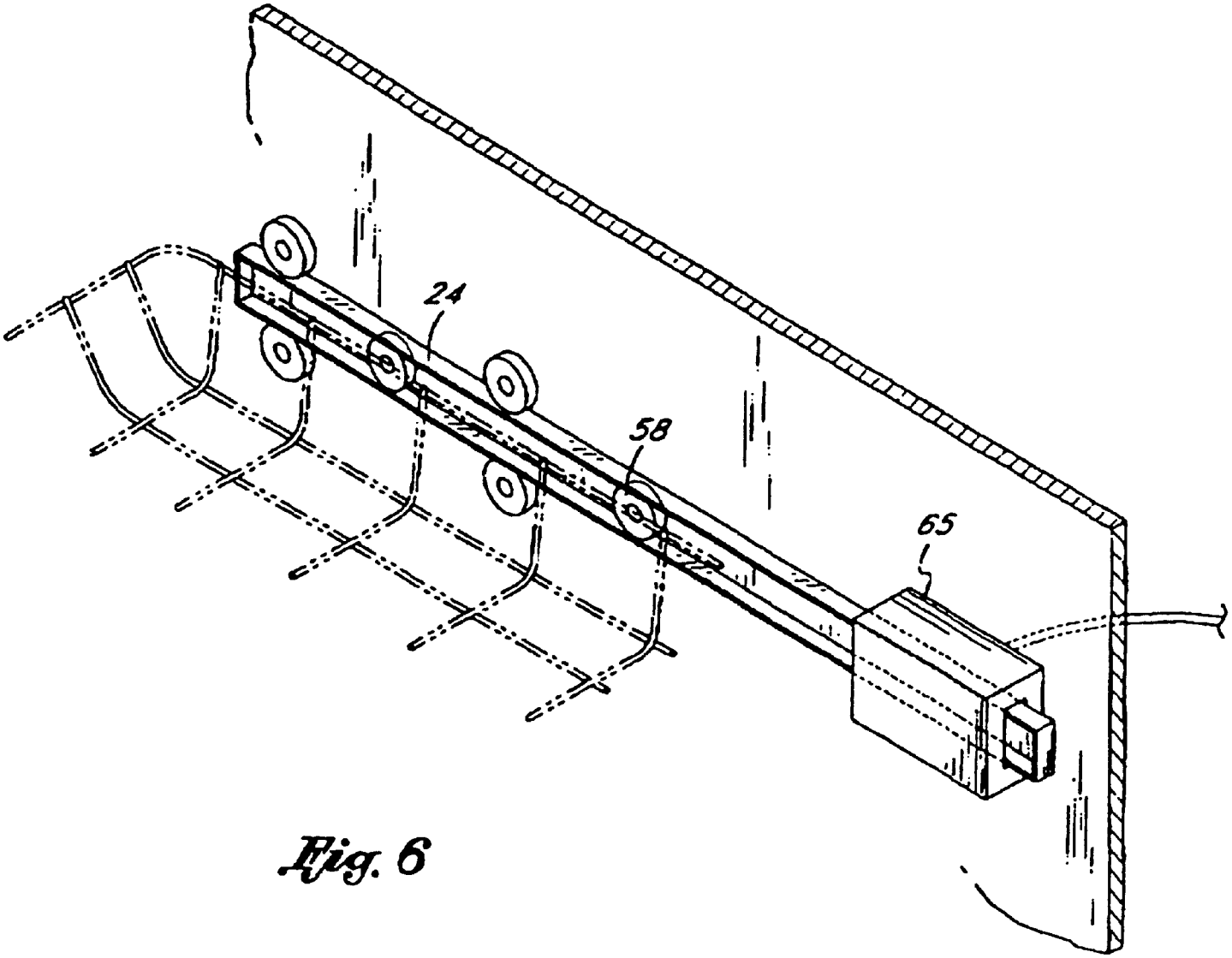
FIG. 6 is a partial cutaway perspective of a slide arm and electromagnetic coil of the invention teaching a relationship of the dish supporting basket thereto.

The above described drawing figures illustrate the invention, a combination sink and dishwashing apparatus 1. The apparatus 1 has a sink 10 sharing a common side wall 20 with a cabinet 30. As shown in FIG. 5, the sink 10 has a bottom wall 12 integral with a side wall 14 which extends upwardly from the bottom wall 12. The common side wall 20 is preferably a portion of side wall 14. The side wall 14 preferably includes a rear side wall 14R, a pair of lateral walls 14L-1 and 14L-2, and a front side wall 14F. The bottom wall 12 and the side wall 14 are preferably joined to form an open-topped box construction. The bottom wall 12 has a drain 16 for allowing water and food refuse to flow out of the sink 10. The drain 16 is preferably connected to a garbage disposal means 18 having a motor 19 for actuation. The food refuse from the sink 10 falls into the garbage disposal means 18 and is ground into pieces small enough to be expelled into the city sewer system through a sewer connecting line 22. The sink 10 preferably includes a faucet 11A and a spray hose 11B, as shown in FIG. 4, which can be used to spray food off the dishes before they are placed into the cabinet 30. The sink 10 is preferably about 1.5 feet wide, 2 feet long and 1 foot deep, and is preferably made of either stainless steel or porcelain. However, materials and sizes are not an essential aspect of this invention, and can be changed to suit any desired configuration and space need.

The apparatus 1 also includes a cabinet 30 that defines a closed space 32 within it. The cabinet 30 is preferably made of stainless steel, although other materials are also suitable, and preferably contains a layer of thermal and or sound insulation. The cabinet 30 preferably is approximately the same size as the sink 10 and a few inches greater in depth. The common side wall 20 is preferably a part of the cabinet 30 that defines the closed space 32 and is positioned to form one side of the sink 10 as described above. The cabinet 30 preferably is a closed cube with one face being formed by the common side wall 20.

Figure 1:
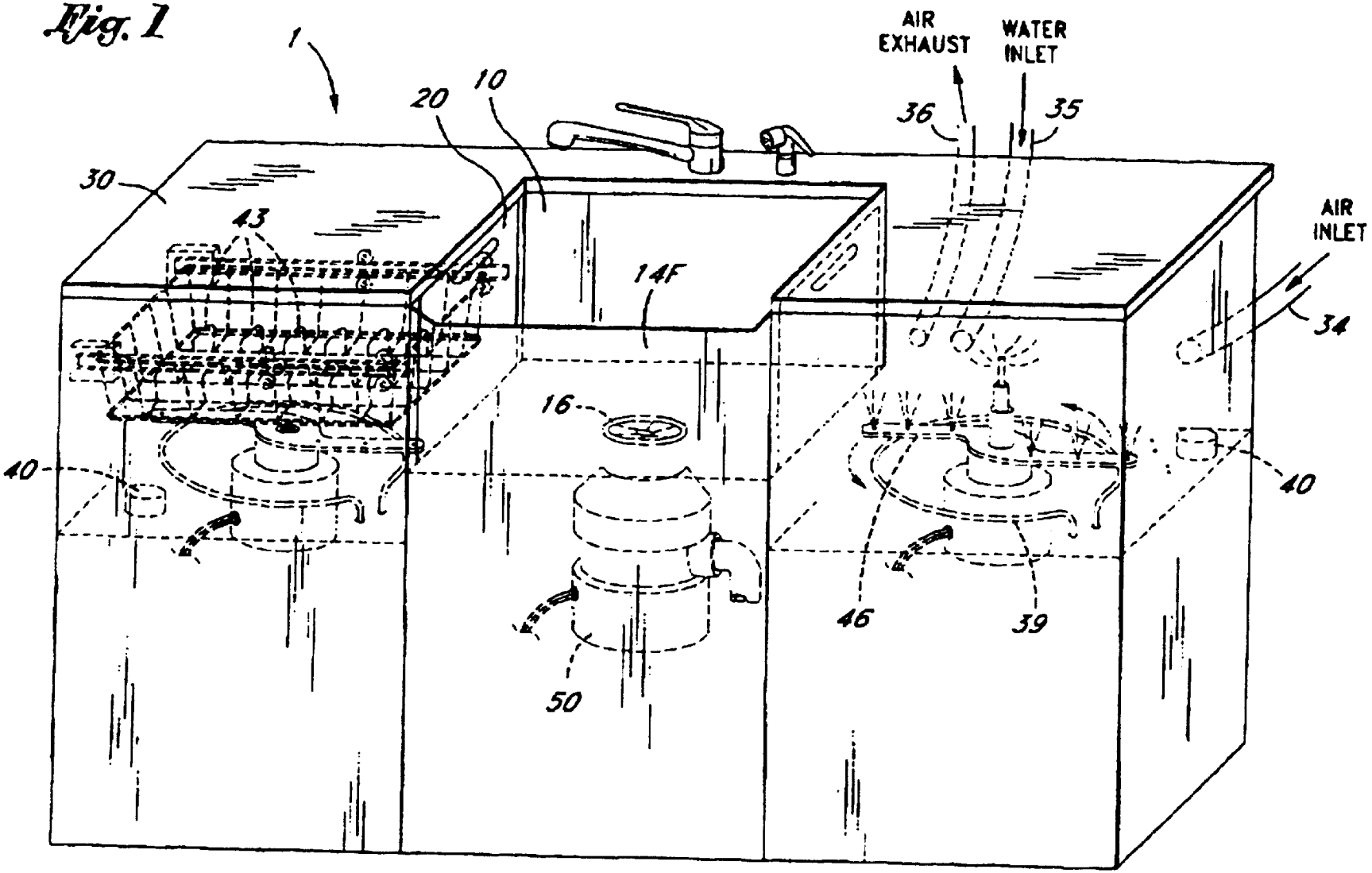
FIG. 1 is a perspective view of an embodiment of the present invention particularly showing a sink having two dishwashing machines located laterally thereto.

As shown in FIG. 1, this cabinet 30 preferably has an air inlet 34 and an air exhaust 36, a water inlet 35, a reservoir 38, and a wire basket 42 having a means for supporting a plurality of dishes 43. The reservoir 38 is preferably a recess approximately 1–2 inches deep in the bottom wall 12 of the cabinet 30. The reservoir 38 preferably has a heating means 39 such as a heating coil used to heat the water in the reservoir 38. The reservoir 38 preferably also has a float valve 40 which shuts off the flow of water from the water inlet 35 into the cabinet 30 when the reservoir 38 is full.

The cabinet 30 also contains a means for spraying 46 which sprays the dishes in the wire basket 42 with water when the wire basket 42 is sealed in the cabinet 30 so as to clean the dishes. As shown in FIG. 3, the means for spraying 46 is preferably a spray arm 46 rotatably mounted within the cabinet 30. The spray arm 46 preferably includes a turbine (not shown) which causes the spray arm 46 to rotate when water is forced through it as is common in dish washer technology. The apparatus further comprising a water recycling means which cycles the water from the cabinet 30 back to the means for spraying 46. The water naturally gathered in the reservoir 38 on the bottom wall 12 of the cabinet 30, where it is heated by the heating means 39. The water recycling means preferably includes a reservoir drain 48 that drains water from the reservoir 38 into a pump 50. FIG. 4 shows one embodiment, in which the water flows directly into the pump 50, where it is returned to the spray arm 46. FIG. 5 shows the preferred embodiment, in which the water flows through a drain pipe 52 into a two way valve 52A. When the apparatus 1 is in use, the two way valve 52A directs the water to a return pipe 52B which returns the water to the pump 50, from which it is returned to the spray arm 46 through a second pipe 54 and sprayed back onto the dishes. When the apparatus 1 is finished washing the dishes the two way valve 52A diverts the water through an exit pipe 52C which leads to the garbage disposal means 18. The pump 50 is preferably an impeller 50. As shown in FIG. 5, the pump 50 is preferably powered by the motor 19 that powers the garbage disposal means 18. In an alternative embodiment, as shown in FIG. 4, separate motors 19A power the individual pumps 50. Finally, the garbage disposal means 18 contains a sewer connecting line 22 that allows water and ground up food refuse to pass from the garbage disposal means 18 to the city sewer system. In the FIG. 5 configuration, the water inlet 35 is preferably connected to the pump 50, so that the water flows through the pump 50, through the second pipe 54 and into the cabinet 30. In the FIG. 4 configuration, the water inlet 35 is preferably connected directly to the pump 50. The cabinet 30 preferably includes a air heater and blower means which heats air and blows the hot air across the dishes to facilitate their drying after they have been washed. Other features can be added, such as a liquid detergent dispenser and a rinse-aid dispenser, but are not central to the inventive nature of this invention and are well known in the art. Some of these details are discussed in other patents, U.S. Pat. Nos. 5,470,142, 5,193,562, 4,919,162, 4,811,997, 4,557,283 4,298,015 and 3,961,984, hereby incorporated in full by reference. Also well known in the art are various control devices used to control the wash, rinse and dry cycles of the apparatus 1, such as a computer means.

As shown in FIG. 1, the wire basket 42 preferably has a means for supporting a plurality of dishes 43, preferably a wire lattice with a plurality of upwardly extending rods. As shown in FIG. 3, the wire basket 42 preferably has a detergent dispensing means 56. The detergent dispensing means 56 is preferably a cup 56A that can be filled with detergent. The cup 56A is hingedly mounted on the wire basket 42. When the apparatus 1 is turned on, a telescoping tower 56B which is mounted on the bottom wall 12 rises and knocks the cup 56A over so as to spill the detergent into the reservoir 38. The wire basket 42 preferably also includes a plurality of wheels 58 that allow the wire basket 42 to roll into and out of the cabinet 30. In one preferred embodiment, as shown in the drawings, a pair of slide arms 24 are rotatably mounted to the side wall 14, one to the front side wall 14F and one to the rear side wall 14R. The wire basket 42 is then slidably mounted to the slide arms 24 by the plurality of wheels 58. In an alternative embodiment, the cabinet 30 has a pair of tracks above the reservoir 38, and the plurality of wheels 58 simply roll across the tracks and across the bottom wall 12 of the sink 10.

The apparatus 1 includes a means for moving which allows the user to move the wire basket 42 between the cabinet 30 and the sink 10; and a means for ingress and egress which allows the user to insert (or remove) the wire basket 42 into (or out from) the cabinet so that the wire basket 42 may be removed from (or sealed into) the cabinet 30. In its preferred configuration, as shown in FIG. 4, the wire basket 42 is attached to the common side wall 20. By pulling the common side wall 20 across the sink, the wire basket 42 is pulled along so that it rolls into the sink 10. This allows the wire basket 42 to be filled with dishes. The common side wall 20 and the wire basket 42 are then pushed back so the wire basket 42 is again within the cabinet 30 and the common side wall 20 again seals the cabinet 30 into a closed space 32. In an alternative configuration, the common side wall 20 is hingedly connected to the cabinet 30. After opening the common side wall 20, the user can pull the wire basket 42 into the sink 10.

The cabinet 30 preferably also includes a locking means 65 such as an electromagnetic coil, which locks the wire basket inside the cabinet 30 when the apparatus 1 is in use. When the apparatus 1 is in use, the electromagnetic coil 65 is charged to form a magnetic bond with the slide arms 24. Once the apparatus 1 is finished washing the dishes, the electromagnetic coil 65 reverses its charge to repel the slide arm 24 and partially open the cabinet 30, not only signaling the user that the process is complete, but also facilitating drying and cooling the interior of the cabinet 30.

In an alternative embodiment, this invention can include two cabinets 30 as described above, located on opposing sides of the sink 10. This dual-washer configuration is not substantially different than the first embodiment; there are simply two cabinets 30, each containing an identical list of the above-identified elements. In the two cabinet version it is possible to move only one of the dish racks into the sink area at one time. However, both of the washers may be operating at the same time. It is obvious that the control device must operate the two wash cycles for the two washers at the same time and such programming is considered a well known part of the prior art.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination sink and dishwashing apparatus comprising:

a sink having a sink bottom wall integral with a sink side wall extending upwardly from the bottom wall, and a drain mounted in the sink bottom wall for allowing water and food refuse to move therein, the sink further providing a means for flushing water into the sink for pre-cleaning dishes;

a cabinet positioned to one side of the sink, the cabinet defining a closed space therewithin and providing a cabinet side wall common to the sink;

a dish supporting means for supporting a plurality of dishes therein;

the cabinet side wall common to the sink being movable for providing ingress and egress of the dish supporting means so that the dish supporting means may be sealed inside the cabinet and thereafter removed to the sink therefrom;

a means for spraying the dishes within the cabinet so as to clean the dishes; and a means for moving the dish supporting means between the cabinet and the sink.

2. The apparatus of claim 1 wherein the spraying means includes a pump and a spray arm, the spray arm being rotatably mounted within the cabinet, the pump supplying a stream of pressurized water to the spray arm for dispersion therefrom.

3. The apparatus of claim 2 wherein the drain further comprises a garbage disposal means driven by a motor, the pump providing an impeller powered by the motor.

4. The apparatus of claim 2 further comprising a heating means for heating the water within the cabinet, and further comprising a water recycling means interconnected for cycling the water from the cabinet, through the pump and the spray arm.

5. The apparatus of claim 2 further comprising a detergent dispensing means pivotally mounted on the dish supporting means, and a telescoping tower enabled by water pressure for pivotally disturbing the detergent dispensing means for spilling the detergent out of the dispensing means.

6. The apparatus of claim 1 further comprising an air inlet means and an air exhaust means for controlling a flow of air into and out of the cabinet.

7. A combination sink and dishwashing apparatus comprising:

a sink having a sink bottom wall integral with a sink side wall extending upwardly from the bottom wall, and a drain mounted in the sink bottom wall for allowing water and food refuse to move therein, the sink further providing a means for flushing water into the sink for pre-cleaning dishes;

a pair of cabinets positioned on opposing sides of the sink, each of the cabinets defining a closed space therewithin and each providing a cabinet side wall common to the sink;

a dish supporting means for supporting a plurality of dishes therein;

each of the cabinet side walls common to the sink being movable for providing ingress and egress of the dish supporting means so that the dish supporting means may be sealed within each said cabinet and thereafter removed to the sink therefrom;

a means for spraying the dishes within each said cabinet so as to clean the dishes; and a means for moving the dish supporting means between each said cabinet and the sink.

8. The apparatus of claim 7 in which the spraying means includes a pump and a spray arm rotatably mounted within each said cabinet, the pump supplying a stream of pressurized water to each said spray arm.

9. The apparatus of claim 8 in which the drain further comprises a garbage disposal means having a motor, wherein the pump is an impeller powered by the motor.

10. The apparatus of claim 8 further comprising a heating means for heating the water within each said cabinet, and further comprising a water recycling means for cycling the water from each said cabinet, through the pump, and said spray arm.

11. The apparatus of claim 7 further comprising an air inlet means and an air exhaust means for controling the flow of air into and out of each of the cabinets.

12. The apparatus of claim 7 further comprising a detergent dispensing means pivotally mounted on the dish supporting means and a telescoping tower enabled by water pressure for pivotally disturbing the detergent dispensing means for spilling the detergent out of the dispensing means.

* * * * *